US008953990B2

(12) United States Patent
Okamoto et al.

(10) Patent No.: US 8,953,990 B2
(45) Date of Patent: Feb. 10, 2015

(54) IMAGE FORMING APPARATUS WITH THE RIGID AND ELASTIC PAPER GUIDES

(71) Applicant: KYOCERA Document Solutions Inc., Osaka-shi, Osaka (JP)

(72) Inventors: Sueaki Okamoto, Osaka (JP); Einosuke Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/905,505

(22) Filed: May 30, 2013

(65) Prior Publication Data

US 2013/0322944 A1 Dec. 5, 2013

(30) Foreign Application Priority Data

May 31, 2012 (JP) ..... 2012-124579
May 31, 2012 (JP) ..... 2012-124580

(51) Int. Cl.
*G03G 15/00* (2006.01)
*G03G 15/16* (2006.01)

(52) U.S. Cl.
CPC ..... *G03G 15/6555* (2013.01); *G03G 15/1695* (2013.01); *G03G 15/6558* (2013.01); *G03G 15/6594* (2013.01)
USPC ..... 399/316; 399/388

(58) Field of Classification Search
CPC ..... G03G 15/1695; G03G 15/6555; G03G 15/6558
USPC ..... 399/388, 390, 303, 394, 395, 397, 316, 399/317
See application file for complete search history.

(56) References Cited

U.S. PATENT DOCUMENTS 5,594,539 A * 1/1997 Murano et al. ..... 399/316
2006/0171760 A1 8/2006 Deguchi (Continued)

FOREIGN PATENT DOCUMENTS

JP S6043671 3/1985
JP H10-326032 12/1998

(Continued)

OTHER PUBLICATIONS

European Search Report.

(Continued)

*Primary Examiner* — Daniel J Colilla
*Assistant Examiner* — Justin Olamit
(74) *Attorney, Agent, or Firm* — Gerald E. Hespos; Michael J. Porco; Matthew T. Hespos

(57) ABSTRACT

An image forming apparatus includes an image bearing member and a transfer member, which form a transfer nip portion, and a guide member for guiding a sheet to the transfer nip portion. The guide member includes a rigid restricting member including a guide surface, a cut portion formed at a leading edge part of the guide surface, and a sheet-like elastic restricting member to cover the cut portion. The elastic restricting member includes an end edge portion extending straight in the sheet width direction on a downstream side in the sheet conveying direction. A ridge defining the leading edge part of the guide surface is a ridge extending straight in the sheet width direction, and the end edge portion of the elastic restricting member is arranged at a position shifted toward an upstream side in the sheet conveying direction from the ridge of the guide surface.

5 Claims, 12 Drawing Sheets

(56) References Cited

U.S. PATENT DOCUMENTS

| | | | | |
|---|---|---|---|---|
| 2007/0269242 | A1 | 11/2007 | Hattori et al. | |
| 2007/0269243 | A1 | 11/2007 | Uehara et al. | |
| 2007/0269244 | A1 | 11/2007 | Miwa et al. | |
| 2007/0297829 | A1 | 12/2007 | Kurosu | |
| 2008/0056781 | A1* | 3/2008 | Michishita | 399/316 |

FOREIGN PATENT DOCUMENTS

| | | |
|---|---|---|
| JP | 2005-266225 | 9/2005 |
| JP | 2006171538 | 6/2006 |
| JP | 2008-26809 | 2/2008 |
| JP | 2008-26810 | 2/2008 |
| JP | 2008-58568 | 3/2008 |
| JP | 2010085491 | 4/2010 |

OTHER PUBLICATIONS

Office Action Issued in Japanese Patent Application No. 2012-124580—Aug. 26, 2014.

Office Action Issued in Japanese Patent Application No. 2012-124579—Aug. 26, 2014.

* cited by examiner

IMAGE FORMING APPARATUS WITH THE RIGID AND ELASTIC PAPER GUIDES

This application is based on Japanese Patent Applications Serial Nos. 2012-124579 and 2012-124580 filed with the Japan Patent Office on May 31, 2012, the contents of which are hereby incorporated by reference.

BACKGROUND

The present disclosure relates to an image forming apparatus for transferring a toner image to a sheet.

An image forming apparatus for transferring a toner image to a sheet includes a transfer nip portion formed by a photoconductive drum forbearing a toner image and a transfer roller to which a transfer bias is applied. A toner image on the circumferential surface of the photoconductive drum is transferred to a surface of a sheet by the sheet passing through this transfer nip portion. A guide member for properly guiding a sheet toward the transfer nip portion is provided immediately upstream of the transfer nip portion in a sheet conveying direction. A main function of the guide member is to prevent so-called transfer scattering (scattering of toner occurring during transfer) which occurs because toner is preliminarily transferred onto a sheet due to a transfer bias in a pre-nip area immediately upstream of the transfer nip portion. To suppress transfer scattering, it is effective to guide a sheet toward the circumferential surface of the photoconductive drum in the pre-nip area. Thus, the guide member is arranged upstream of the transfer nip portion to enable sheet guidance.

In the guide member as described above, in order to moderate an impact or reduce a conveying load in passing thick paper such as postcards through the transfer nip portion, it is known to provide a cut portion in the form of a recess having a postcard size on a guide surface of the guide member. There is also a technology for suppressing the occurrence of image defects such as missing images by covering the cut portion with a sheet-like elastic member from above.

However, in the above configuration, the trailing end of a sheet may flap because of the elastic member when leaving an end edge of the elastic member. If such flapping of the sheet occurs in the pre-nip area, toner may scatter and a transferred image on the sheet may be blurred.

SUMMARY

An image forming apparatus according to one aspect of the present disclosure includes an image bearing member, a transfer member and a guide member. The image bearing member includes an image bearing surface for bearing a toner mage to be transferred to a sheet. The transfer member is arranged such that a circumferential surface thereof is in contact with the image bearing surface, and a transfer nip portion is formed between the transfer member and the image bearing member. The guide member is arranged near an upstream side of the transfer nip portion in a sheet conveying direction and guides an under surface side of the sheet being conveyed in a horizontal direction to introduce the sheet to the transfer nip portion.

The guide member includes a rigid restricting member, a cut portion and an elastic restricting member. The rigid restricting member is formed of a rigid member and includes a guide surface which faces the under surface side of the sheet being conveyed. The cut portion is formed by recessing a leading edge part of the guide surface on a downstream side in the sheet conveying direction and the vicinity thereof and has a predetermined width along a sheet width direction perpendicular to the sheet conveying direction. The elastic restricting member is formed of an elastic member and arranged on the guide surface to cover the cut portion. The elastic restricting member includes an end edge portion extending straight in the sheet width direction on a downstream side in the sheet conveying direction. A ridge defining the leading edge part of the guide surface is a ridge extending straight in the sheet width direction. The end edge portion of the elastic restricting member is arranged at a position shifted toward an upstream side in the sheet conveying direction from the ridge of the guide surface.

These and other objects, features and advantages of the present disclosure will become more apparent upon reading the following detailed description along with the accompanying drawings.

DETAILED DESCRIPTION

Figure 1:
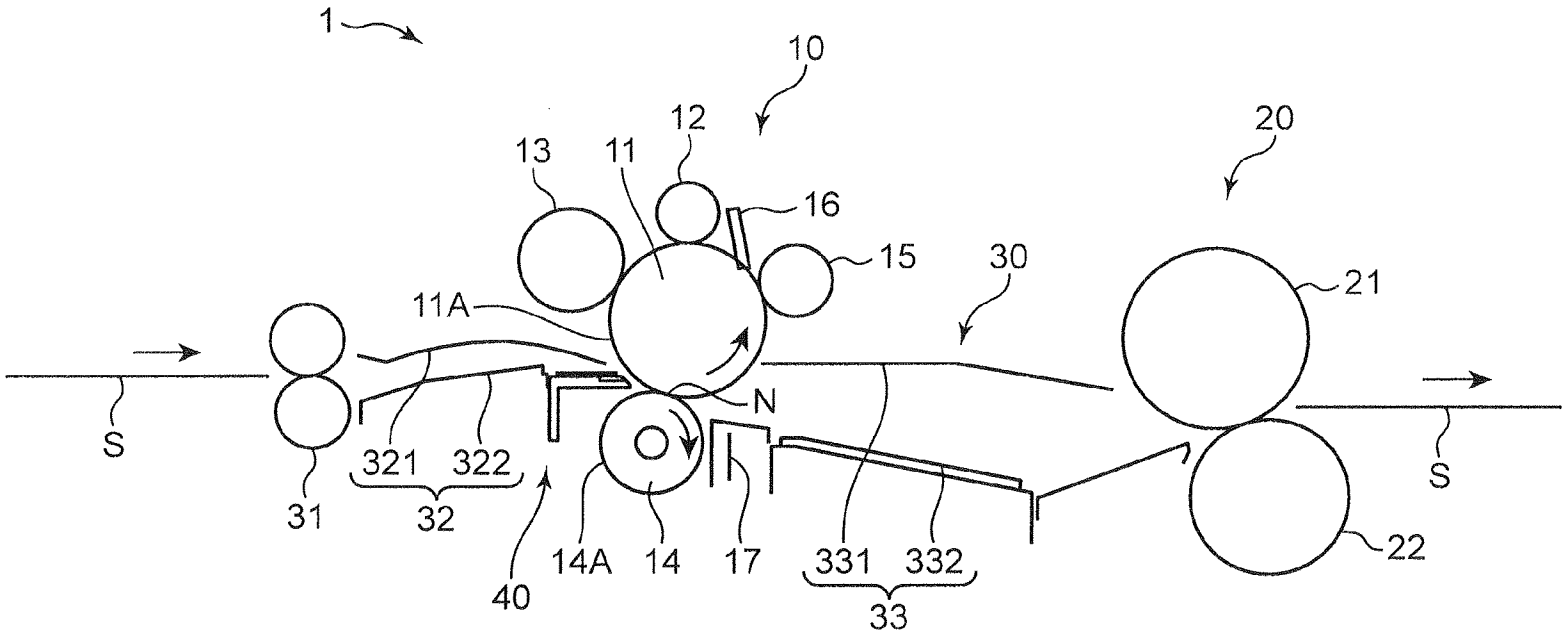
FIG. 1 is a diagram schematically showing an essential part of an image forming apparatus according to an embodiment of the present disclosure.

Hereinafter, embodiments of the present disclosure are described with reference to the drawings. FIG. 1 is a diagram schematically showing an essential part of an image forming apparatus 1 according to an embodiment of the present disclosure. The image forming apparatus 1 is, for example, a printer, a copier, a facsimile machine or a complex machine of these.

The image forming apparatus 1 includes an image forming unit 10 for transferring a toner image to a sheet S, a fixing unit 20 for fixing the toner image to the sheet S and a sheet conveyance path 30 for conveying the sheet S by way of the image forming unit 10 and the fixing unit 20. Although not shown, the image forming apparatus 1 includes, besides these, a sheet cassette for storing sheets to which a toner image is to be transferred, a toner container for storing toner and the like, which are housed in an unillustrated housing. Note that a sheet discharge tray for receiving the sheet S finished with transfer and fixing processes is provided in the housing.

The image forming unit 10 includes a photoconductive drum 11 (image bearing member), a charging roller 12, an unillustrated exposure device, a developing roller 13, a transfer roller 14 (transfer member), a rubbing roller 15, a cleaning blade 16 and a static charge eliminator 17.

The photoconductive drum 11 is a cylindrical member and carries an electrostatic latent image and a toner image on a circumferential surface 11A (image bearing surface) thereof. The photoconductive drum 11 is rotated in a counterclockwise direction as indicated by an arrow in FIG. 1 upon receiving a drive force from an unillustrated motor. A photoconductive drum made of an amorphous silicon (a-Si) based material can be used as the photoconductive drum 11. An example of its configuration is that a carrier injection inhibiting layer made of Si:H:B:O or the like, a photoconductive layer made of Si:H or the like, a surface protection layer made of SiC:H or the like are successively laminated on a conductive base.

The charging roller 12 is a roller held in contact with the circumferential surface 11A of the photoconductive drum 11 and uniformly charges the circumferential surface 11A. The exposure device includes optical devices such as a laser light source, a polygon mirror and an fθ lens and forms an electrostatic latent image by irradiating laser light modulated based on image data to the circumferential surface 11A of the photoconductive drum 11. The developing roller 13 is a roller having a circumferential surface for carrying toner, and forms a toner image by supplying the toner to the circumferential surface 11A of the photoconductive drum 11 bearing an electrostatic latent image. Developer used in this embodiment contains toner particles and magnetic powder and, in addition, abrasive particles are fixed to the surfaces of the toner particles. The abrasive particles are particles with high hardness, e.g. metal oxide of alumina, zirconia, titania or the like.

The transfer roller 14 is arranged below the photoconductive drum 11 and rotates in a clockwise direction in this embodiment. A circumferential surface 14A of the transfer roller 14 is held in contact with the circumferential surface 11A of the photoconductive drum 11 with a predetermined pressure, whereby a transfer nip portion N is formed. The transfer roller 14 is an electrically conductive elastic roller (sponge roller) and applies a transfer bias to a sheet S from an under surface side of the sheet S when the sheet S passes through the transfer nip portion N. By applying electric charges to the sheet S, a toner image carried on the circumferential surface 11A of the photoconductive drum 11 is transferred to the sheet S in the transfer nip portion N.

The rubbing roller 15 is a roller whose circumferential surface is held in contact with the circumferential surface 11A of the photoconductive drum 11 with a biasing force and which cleans the circumferential surface 11A. Ion products may be formed on the circumferential surface 11A in an image forming process. The rubbing roller 15 rubs and abrades the ion products. The abrasive particles are added to the developer as described above, and the rubbing roller 15 abrades the circumferential surface 11A using the abrasive particles as an abrasive material by rotating in contact with the circumferential surface 11A.

The cleaning blade 16 is provided above the rubbing roller 15 and removes the toner remaining on the circumferential surface 11A of the photoconductive drum 11 by sliding in contact with the circumferential surface 11A. The remaining toner scraped off by the cleaning blade 16 is collected by a toner collecting screw (not shown). The static charge eliminator 17 is arranged downstream of the transfer nip portion N and eliminates electric charges of the sheet S which may be charged by the application of the transfer bias.

The fixing unit 20 includes a fixing roller 21 with a built-in heater and a pressure roller 22 provided at a position to face the fixing roller 21. A circumferential surface of the pressure roller 22 is pressed in contact with that of the fixing roller 21, thereby forming a fixing nip portion. The fixing unit 20 fixes the toner image on the sheet S to the sheet S by conveying the sheet having the toner image transferred thereto while heating and pressing the sheet S by the fixing roller 21 and the pressing roller 22.

The sheet conveyance path 30 includes a pre-transfer conveyance path 32 arranged upstream of the transfer nip portion N and a post-transfer conveyance path 33 arranged downstream of the transfer nip portion N when being defined with respect to a conveying direction (direction from left to right as indicated by arrows in FIG. 1) of the sheet S. The pre-transfer conveyance path 32 and the post-transfer conveyance path 32 are both conveyance paths for conveying the sheet S substantially in a horizontal direction.

The pre-transfer conveyance path 32 is a conveyance path for guiding the sheet S to the transfer nip portion N and includes an upper guide member 321 and a lower guide member 322 arranged below the upper guide member 321 to face the lower surface of the upper guide member 321. The post-transfer conveyance path 33 is a conveyance path for guiding the sheet S having passed through the transfer nip portion N to the fixing unit 20 and similarly includes an upper guide member 331 and a lower guide member 332 arranged below the upper guide member 331 to face the lower surface of the upper guide member 331. The upper guide members 321, 331 guide an upper surface (transfer surface) side of the sheet S being conveyed in the horizontal direction and the lower guide members 322, 332 guide an under surface side of the sheet S.

A pair of registration rollers 31 are arranged at an upstream end of the pre-transfer conveyance path 32. The sheet S is temporarily stopped at the pair of registration rollers 31 and sent out to the transfer nip portion N at a predetermined timing for image transfer after a skew correction is made. In this embodiment, as shown in FIG. 1, the pair of registration rollers 31 are not arranged on a tangent to the transfer nip portion N, but at a position below this tangent. This is because a developer housing (not shown) that houses the developing roller 13 takes up a space in a direction of the tangent and such an interior layout is often seen in small-size image forming apparatuses. Because of this layout, the pre-transfer conveyance path 32 (upper guide member 321) is a conveyance path curved to be convex upward in a side view.

A guide member 40 is arranged between a downstream end of the lower guide member 322 of the pre-transfer conveyance path 32 and the transfer nip portion N, i.e. near an upstream side of the transfer nip portion N. The guide member 40 is arranged to guide the under surface side of the sheet S being conveyed in the horizontal direction and convey the sheet S to the transfer nip portion N in a preferable insertion posture at a side immediately upstream of the transfer nip portion N. The preferable insertion posture is a posture in which pre-transfer in a pre-nip area can be prevented as described above and the sheet S is inserted into the transfer nip portion N while being as close to the circumferential surface 11A of the photoconductive drum 11 as possible.

Figure 2:
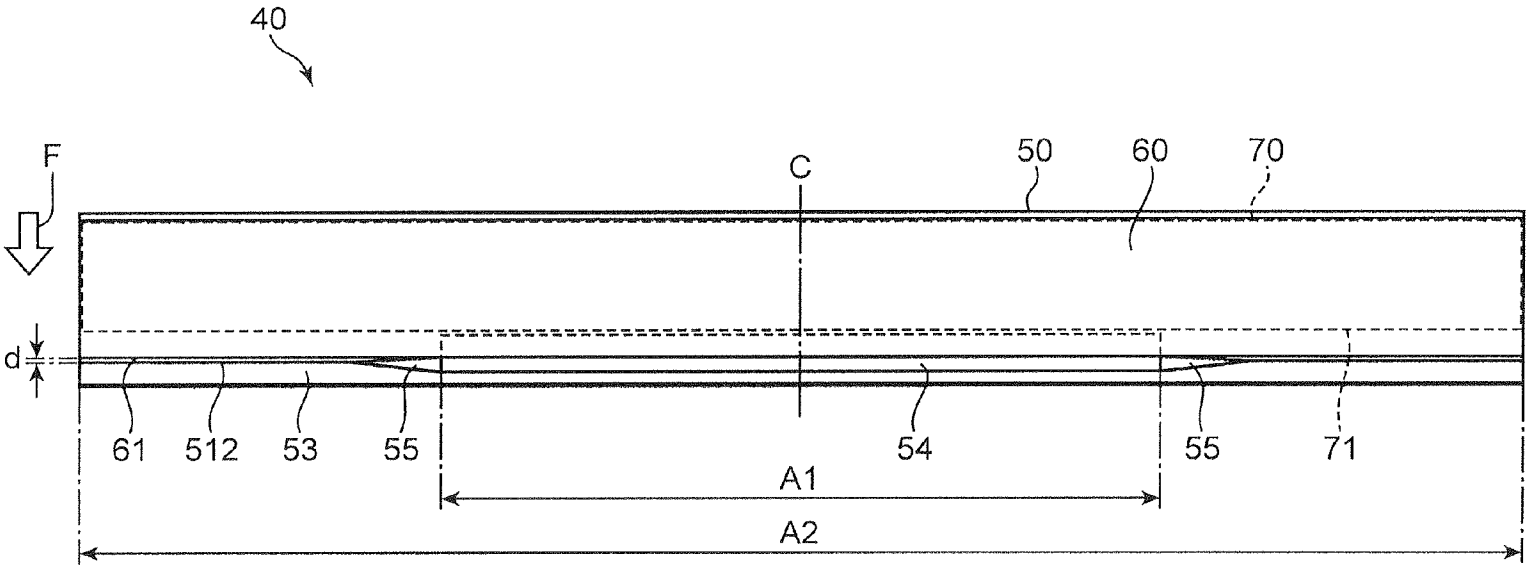
FIG. 2 is a top view of a guide member according to the embodiment of the present disclosure.
Figure 3:
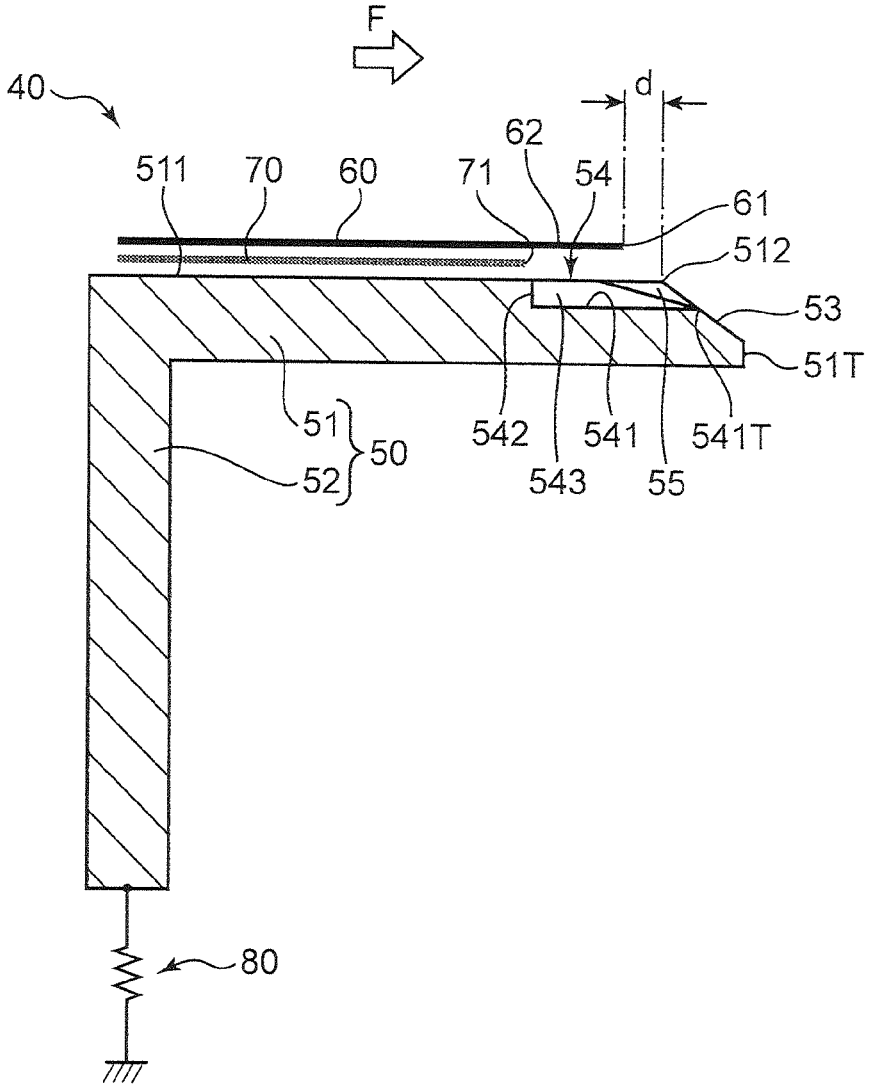
FIG. 3 is a side view in section of the guide member near a center line.

The guide member 40 is described in detail below. FIG. 2 is a top view of the guide member 40 according to this embodiment and FIG. 3 is a side view in section of the guide member 40 along a center line C. The guide member 40 includes a rigid restricting member 50 formed of a rigid member, a sheet-like elastic restricting member 60 formed of an elastic member and an adhesive layer 70 for adhering the elastic restricting member 60 to the rigid restricting member 50.

The rigid restricting member 50 is a member long in a sheet width direction perpendicular to a sheet conveying direction (shown by an arrow F in FIGS. 2 and 3), and a member obtained by molding an electrically conductive and rigid resin material into an L-shaped plate in side view is used as such in this embodiment. Specifically, the rigid restricting member 50 includes a horizontal piece 51 extending in the horizontal direction along the sheet conveying direction and a vertical piece 52 hanging vertically downward from an upstream end of the horizontal piece 51 in the sheet conveying direction. A length of the rigid restricting member 50 in the sheet width direction is substantially equal to a length of the photoconductive drum 11 in an axial direction. A flat guide surface 511 facing the under surface side of the sheet S being conveyed is provided on the upper surface of the horizontal piece 51.

The elastic restricting member 60 is a sheet-like member formed of a flexible and electrically conductive resin film and long in the sheet width direction. A length of the elastic restricting member 60 in the sheet width direction is substantially equal to a length of the guide surface 511 in the sheet width direction and a length of the elastic restricting member 60 in the sheet conveying direction is slightly shorter than a length of the guide surface 511 in the sheet conveying direction. The elastic restricting member 60 is desirably made of a material which is abrasion resistant and has a low coefficient of friction (0.15 or lower). This can ensure resistance of the sheet S against sliding contact and reduce a frictional force when the sheet S slides in contact. Further, the elastic restricting member 60 desirably has a specific elastic force selected from a range of from 0.002 gf/mm2, inclusive, to 0.02 gf/mm2, inclusive. The elastic restricting member 60 includes a leading end portion 61 (end edge portion) extending straight in the sheet width direction on a downstream side in the sheet conveying direction.

The adhesive layer 70 is arranged to adhere the under surface of the elastic restricting member 60 to the guide surface 511 of the rigid restricting member 50 except in a downstream area of the elastic restricting member 60 in the sheet conveying direction (non-adhesion area 62). In this embodiment, an electrically insulating adhesive material is used as the adhesive layer 70. A length of the adhesive layer 70 in the sheet width direction is substantially equal to the lengths of the elastic restricting member 60 and the guide surface 511 in the sheet width direction. An upstream end of the adhesive layer 70 in the sheet conveying direction substantially coincides with that of the elastic restricting member 60, but a downstream end (leading end portion 71) of the adhesive layer 70 in the sheet conveying direction is retracted by a predetermined distance toward the upstream side from that (leading end portion 61) of the elastic restricting member 60. In this way, the non-adhesion area 62 is formed on the downstream side of the elastic restricting member 60.

Figure 4:
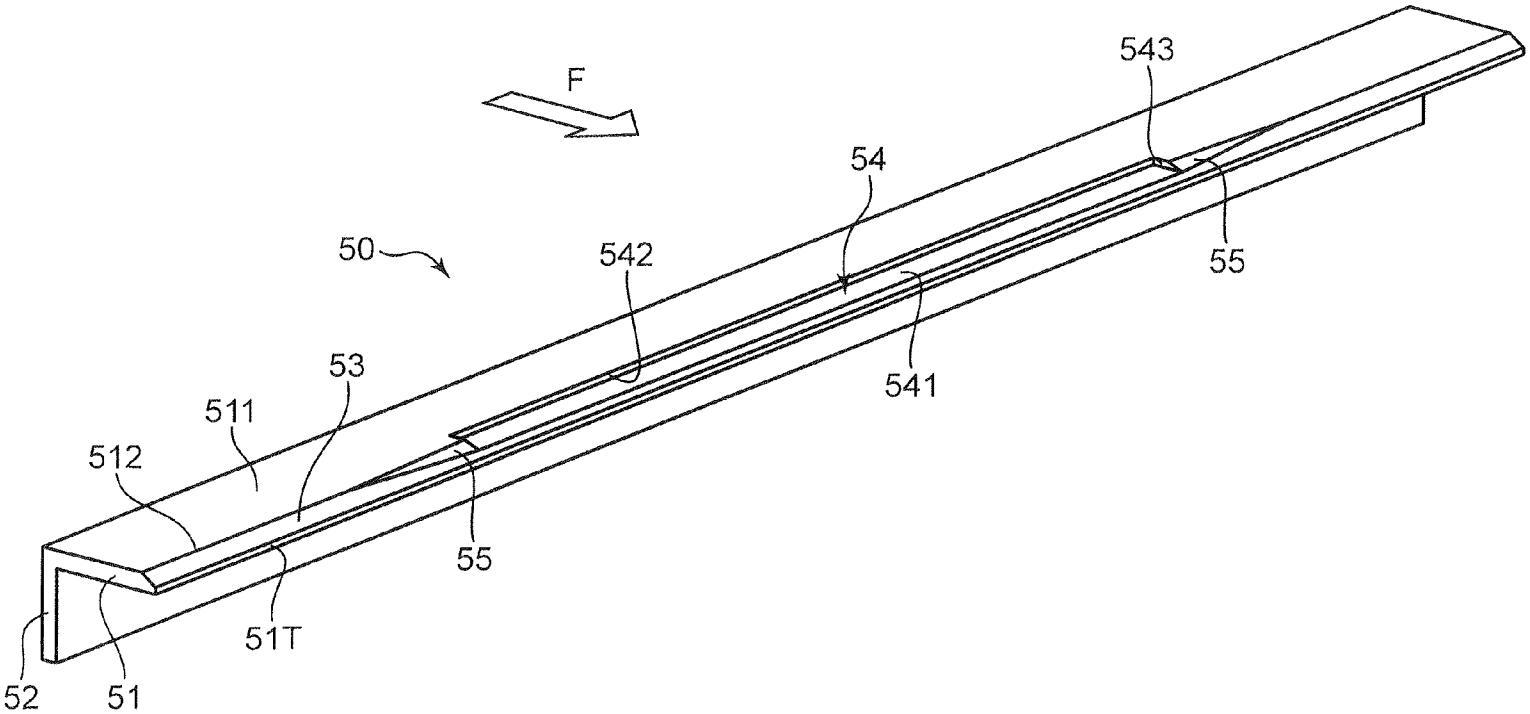
FIG. 4 is a perspective view of a rigid restricting member.
Figure 5:
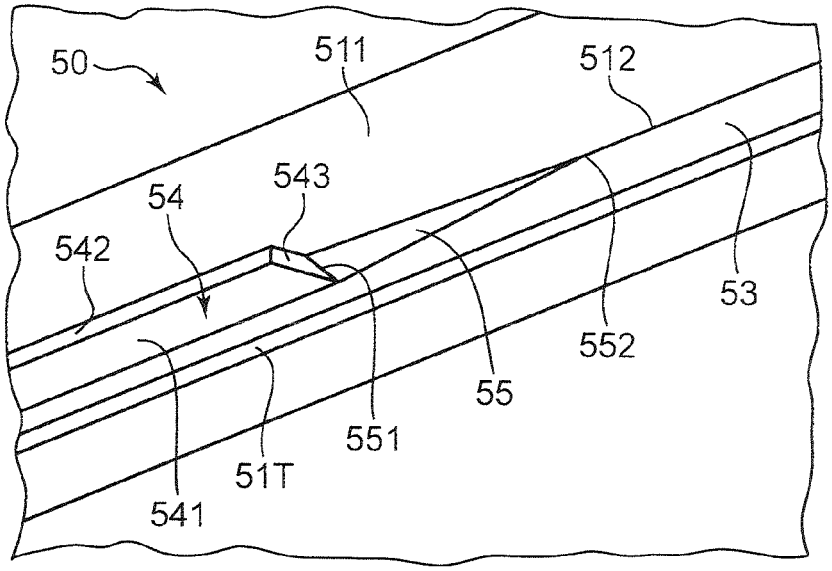
FIG. 5 is an enlarged view of an essential part of FIG. 4.

Next, a detailed structure of the rigid restricting member 50 is described further with reference to FIGS. 4 and 5. FIG. 4 is a perspective view of the rigid restricting member 50 and FIG. 5 is an enlarged view of an essential part of FIG. 4. The horizontal piece 51 of the rigid restricting member 50 includes a tip slant 53, a cut portion 54 and moderating surfaces 55 in addition to the guide surface 511 described above.

The tip slant 53 is connected to a leading edge part of the guide surface 511 in the sheet conveying direction and is inclined downward. The leading edge part of the guide surface 511 is defined by a ridge 512 extending straight in the sheet width direction. The tip slant 53 is an inclined surface which extends obliquely downward toward a downstream side from this ridge 512 as an uppermost part and reaches a leading end edge 51T of the horizontal piece 51 as a lowermost part. In other words, the leading edge part (ridge 512) of the guide surface 511 is located at a most downstream position in conventional apparatuses, but the tip slant 53 is additionally provided at a downstream side of the leading edge part to shift the most downstream position of the guide member 40 in a downstream direction.

The cut portion 54 is in the form of a shallow strip-shaped recess formed at and near the ridge 512 on the downstream side of the guide surface 511 in the sheet conveying direction and has a predetermined width in the sheet width direction. A center of the cut portion 54 in the sheet width direction coincides with a center of the guide surface 511 in the sheet width direction (center liner C shown in FIG. 2). The cut portion 54 is defined by a bottom surface 541 which is flat and long in the sheet width direction, a rear wall 542 which stands up from an upstream end of the bottom surface 541 and side walls 543 which are located at opposite ends of the bottom surface 541 in the sheet width direction. As shown in FIG. 3, a downstream end edge 541T of the bottom surface 541 is located in the tip slant 53. Thus, a width of the tip slant 53 in the sheet conveying direction is narrower in an area corresponding to the cut portion 54 than in other areas.

The moderating surfaces 55 are so-called C-surfaces (chamfer) provided from the respective side walls 543 of the cut portion 54 to corresponding end parts of the guide surface 511 in the sheet width direction to moderate a step between the ridge 512 of the guide surface and the bottom surface 541 of the cut portion 54. As shown in FIG. 5, a base end edge 551 of the moderating surface 55 is a ridge inclined from an intermediate position of the side wall 543 in the sheet conveying direction as an upper end to the bottom surface 541 as a lower end. The moderating surface 55 becomes gradually narrower from this base end edge 551 toward an end part in the sheet width direction and a leading end portion 552 converges to the ride 512. By forming such moderating surfaces 55, it can be prevented that the under surface of the sheet S being conveyed is strongly rubbed by downstream end edges of the side walls 543. Thus, frictional charging of the guide member 40 can be suppressed. Note that although the C-surfaces that are flat cut surfaces are illustrated as the moderating surfaces 55 here, the moderating surfaces 55 may be moderately curved R-surfaces.

With reference to FIG. 2, a length A2 of the guide surface 511 in the sheet width direction is set at a length corresponding to a width of plain paper sheets, e.g. A4 size (first size) sheets which pass through the transfer nip portion N. On the other hand, a length A1 of the cut portion 54 in the sheet width direction is set at a length corresponding to special sheets having a smaller size than plain paper sheets, e.g. postcard size (second size) sheets. That is, when a postcard is passed through the transfer nip portion N, it is guided in an area of the cut portion 54.

Figure 6:
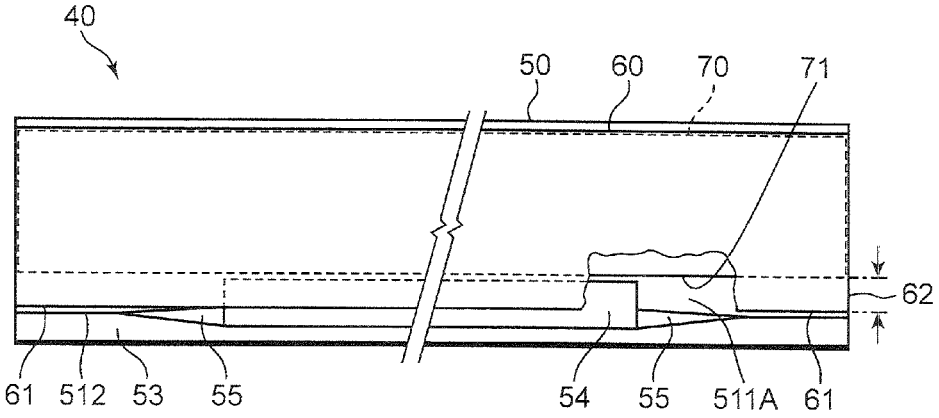
FIG. 6 is a top view, partly cut away, of the guide member.

FIG. 6 is a top view, partly cut away, of the guide member 40. With reference to FIGS. 3 and 6, the guide surface 511 of the rigid restricting member 50 is a strip-shaped flat surface extending in the sheet width direction and the ridge 512 defining the leading edge part thereof is a ridge extending straight in the sheet width direction. Similarly, the elastic restricting member 60 is also a sheet-like member extending in the sheet width direction, and the leading end portion 61 thereof extends straight in the sheet width direction. The leading end portion 71 of the adhesive layer 70 also extends straight in the sheet width direction and is located near the rear wall 542 of the cut portion 54. That is, the elastic restricting member 60 is not adhered to the guide surface 511 over the entire surface by the adhesive layer 70. A downstream end area corresponding to an area from the leading end portion 61 of the elastic restricting member 60 substantially to the position of the rear wall 542 is the aforementioned non-adhesion area 62.

Accordingly, the elastic restricting member 60 can deflect downward in the non-adhesion area 62 and come into contact with leading end areas 511A located at opposite sides of the cut portion 54 of the guide surface 51. In this way, an electrically conductive path between the elastic restricting member 60 and the rigid restricting member 50 can be ensured. Thus, by connecting the rigid restricting member 50 to a ground circuit 80 (FIG. 3), even if the elastic restricting member 60 is rubbed against the sheet S being conveyed to be frictionally charged, electric charges are grounded by the ground circuit 80 through the rigid restricting member 50. Particularly, the non-adhesion area 62 of the elastic restricting member 60 more easily comes into surface contact with the leading end areas 511A since being pressed downward by the sheet S being conveyed. Thus, the elastic restricting member 60 can be reliably grounded. If the elastic restricting member 60 is frictionally charged, the toner electrically adheres to the surface of the elastic restricting member 60. However, since electric charges of the elastic restricting member 60 are allowed to reliably escape to the ground circuit 80 according to this embodiment, the adhesion of the toner to the surface of the elastic restricting member 60 and the smear of the leading end and the under surface of the sheet associated with that can be prevented.

Note that the electrically conductive path can be ensured also by a technique of using an electrically conductive adhesive as the adhesive layer 70 or engaging the elastic restricting member 60 with the rigid restricting member 50 by metal screws. However, the former leads to a cost increase since the relatively expensive electrically conductive adhesive is used and the latter has a problem of increasing the numbers of parts and assembling steps. Contrary to this, according to this embodiment, there are advantages that the adhesive layer 70 can be formed by an inexpensive and general-purpose double-faced adhesive tape and the number of operation steps does not increase since it is sufficient simply to adhere the elastic restricting member 60 onto the adhesive layer 70.

The elastic restricting member 60 is arranged on the guide surface 511 to cover the cut portion 54. However, the elastic restricting member 60 does not completely cover the cut portion 54 from above. In this embodiment, the leading end portion 61 of the elastic restricting member 60 is arranged at a position shifted a distance d toward an upstream side in the sheet conveying direction from the ridge 512 of the guide surface 511. The distance d is preferably selected from a range of about 0.3 mm to 2.0 mm.

In this way, the trailing end of the sheet S being conveyed toward the transfer nip portion N temporarily comes into contact with the guide surface 511 near the ridge 512 immediately after leaving the leading end portion 61 of the elastic restricting member 60. That is, the trailing end of the sheet S is prevented from largely swinging immediately after leaving the elastic restricting member 60. Note that if the distance d is shorter than 0.3 mm, an effect of suppressing swinging movements of the sheet trailing end is reduced. On the other than, if the distance d is longer than 2.0 mm, a degree of elastic deformation of the elastic restricting member 60 utilizing the cut portion 54 becomes smaller to reduce an effect of reducing a conveying load as described later.

Further, since the tip slant 53 is provided downstream of the ridge 512, the trailing end of the sheet S does not suddenly swing in a direction away from the circumferential surface 11A of the photoconductive drum 11 immediately after leaving the guide surface 511. Furthermore, since the downstream end edge 541T of the bottom surface 541 of the cut portion 54 is located in the tip slant 53, the sheet S being conveyed along the cut portion 55 also does not suddenly swing in the direction away from the circumferential surface 11A of the photoconductive drum 11 immediately after leaving the guide surface 511. Thus, the trailing ends of sheets S of any size do not largely swing when passing through the guide member 40 and the flapping of the sheet trailing ends can be more preferably and satisfactorily suppressed.

Figure 7A:
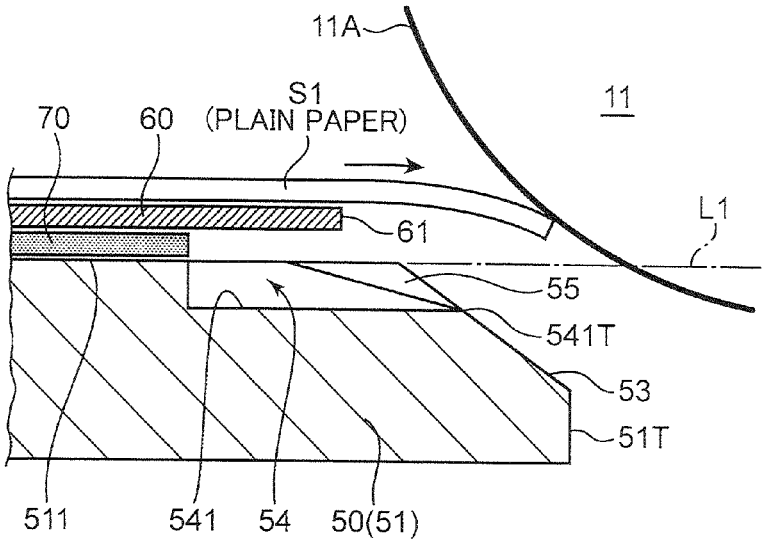
FIGS. 7A and 7B are side views in section showing a state where a sheet is passing through the guide member.
Figure 7B:
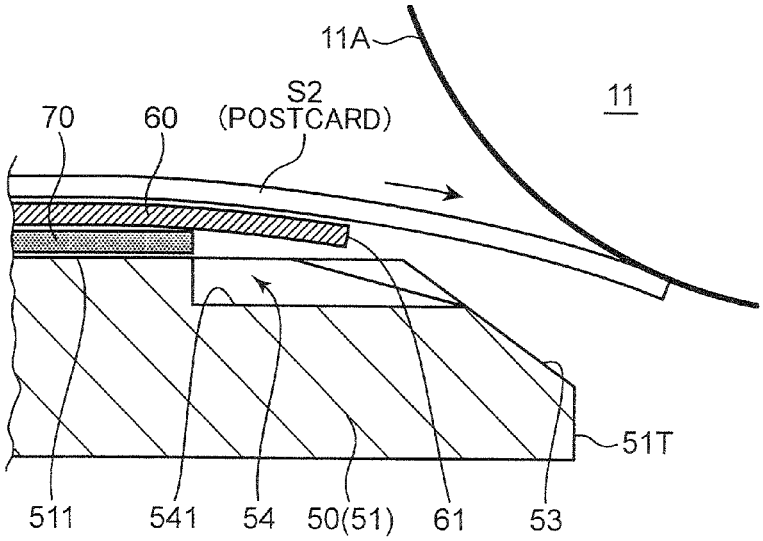

Next, an operation of guiding a sheet S by the guide member 40 is described. FIGS. 7A and 7B are side views in section showing a state where the leading end of a sheet is passing through the guide member 40. FIG. 7A shows a case where the leading end of a plain paper sheet S1 (e.g. A4 size sheet) is passing through the guide member 40 and FIG. 7B shows a case where the leading end of a sheet S2 having a postcard size is passing through the guide member 40.

As shown in FIG. 7A, the rigid restricting member 50 is so arranged with respect to the photoconductive drum 11 that an extended line L1 extending along the guide surface 511 intersects with the circumferential surface 11A of the photoconductive drum 11 and, on the other hand, the tip slant 53 faces the circumferential surface 11A in a side view viewed in a drum axial direction. That is, the guide surface 511 is arranged above (closer to the circumferential surface 11A than) the tangent to the transfer nip portion N and, out of the guide member 40, the tip slant 53 is closest to the circumferential surface 11A.

When the sheet S1 passes while sliding in contact with the elastic restricting member 60, a central part of the sheet S1 in the sheet width direction passes above the central part of the elastic restricting member 60, which can be curved and deformed downward by forming the cut portion 54, in the sheet width direction. However, opposite end parts of the sheet S in the sheet width direction pass above the opposite end parts of the elastic restricting member 60 in the sheet width direction, the under surfaces of which are supported by the leading end areas 511A located at the opposite sides of the cut portion 54 on the guide surface 511. Thus, the leading end of the sheet S comes into contact with the circumferential surface HA from a position above the extended line L1 extending along the guide surface 511. This enables the sheet S to be guided to the transfer nip portion N in a state where the sheet S is proximate to the circumferential surface HA in the pre-nip area immediately upstream of the transfer nip portion N in the conveying direction. Therefore, pre-transfer to the sheet S1 can be suppressed.

Note that after the leading end of the sheet S1 is nipped in the transfer nip portion N, a central part of the elastic restricting member 60 in the sheet width direction drops into the cut portion 54 to be curved and deformed by being pressed by the central part of the sheet S1 in the sheet width direction. At this time, the sheet S is likely to be strongly rubbed against the upper edges of the side walls 543 of the cut portion 54 since the leading end portion 61 of the elastic restricting member 60 is shifted the distance d toward the upstream side in the sheet conveying direction from the ridge 512 of the guide surface 511. However, since the aforementioned moderating surfaces 55 are provided on the side walls 543 to chamfer sharp projecting parts, it can be suppressed that the sheet S1 is strongly rubbed. Thus, the formation of noise images in the form of longitudinal streaks can be prevented.

Next, when the leading end of the sheet S2 having a postcard size passes through the guide member 40 as shown in FIG. 7B, the sheet S2 is guided to pass above the cut portion 54. Accordingly, when the leading end of the sheet S2 passes above the vicinity (non-adhesion area 62) of the downstream end of the elastic restricting member 60, the leading end portion 61 is curved downward to drop into a cavity of the cut portion 54 by being pressed by the sheet S2. Thus, the sheet S2 is guided toward the transfer nip portion N via a route closer to the tangent to the transfer nip portion N than the sheet S1.

A size of postcards in the sheet conveying direction is as short as 140 mm. Accordingly, when the sheet S2 passes through the transfer nip portion N, there is a timing at which the sheet S2 is temporarily conveyed depending only on a conveying force of the transfer nip portion N. In short, in this embodiment, a distance between the pair of registration rollers 31 and the transfer nip portion N is 70 mm and a distance between the transfer nip portion N and the fixing nip portion of the fixing unit 20 is 110 mm. The conveying force of the transfer nip portion N formed using the transfer roller 14 formed of a sponge roller is not strong very much. On the other hand, since the pre-transfer conveyance path 32 is convexly curved for the convenience of the interior layout as described above, a conveying load of the sheet S2 is not small. In addition to this, the guide member 40 for guiding the sheet toward the circumferential surface 11A is arranged in the pre-nip area in this embodiment. Thus, a conveying load of the sheet is even larger. Therefore, the apparatus is so configured that it is sufficiently difficult to achieve a conveying speed of the sheet S at which an image is satisfactorily transferred (conveying speed capable of performing slip transfer to differentiate between a circumferential speed of the circumferential surface 11A and the conveying speed of the sheet S2).

However, in this embodiment, the elastic restricting member 60 deflects downward when the sheet S2 passes since the cut portion 54 corresponding to the size of the sheet S2 is formed. A bending degree of the conveyance path of the sheet S2 is moderated by this deflection. Thus, the conveying load of the sheet S2 can be reduced. On the other hand, for the plain paper sheet S1 having a sufficient length in the sheet conveying direction, the leading end of the sheet S1 can extend along the circumferential surface 11A in the pre-nip area without being affected by the cut portion 54 as shown in FIG. 7A since the elastic restricting member 60 covers the cut portion 54 from above.

Figure 8A:
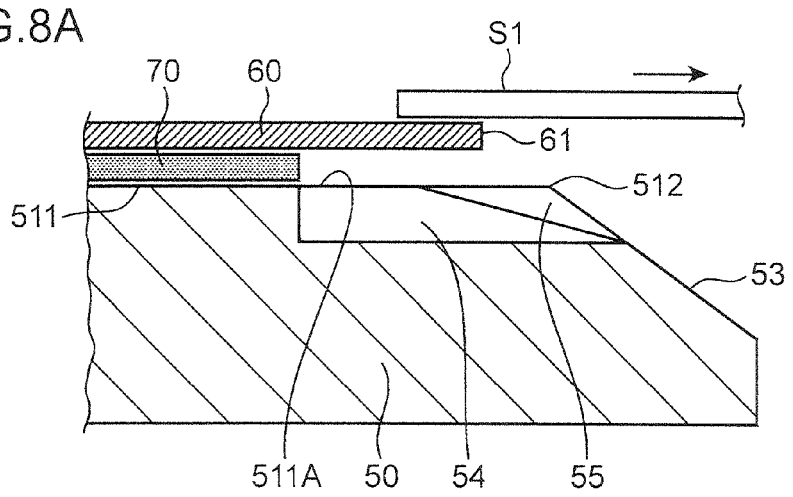
FIGS. 8A, 8B and 8C are side views in section showing a state where the trailing end of a sheet is passing through the guide member.
Figure 8B:
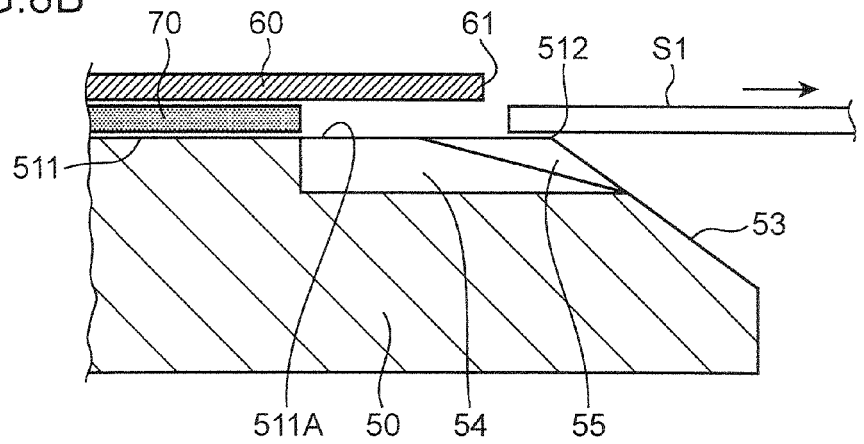
Figure 8C:
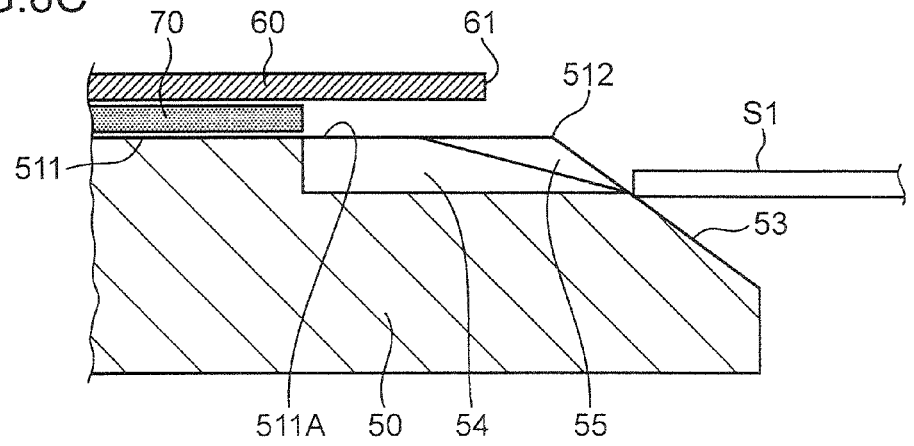

Next, a state where the trailing end of the plain paper sheet S1 is passing through the guide member 40 is described based on FIGS. 8A to 8C. FIG. 8A is a diagram showing a state immediately before the trailing end of the sheet S1 leaves the leading end portion 61 of the elastic restricting member 60. In this state, the trailing end of the sheet S1 slides in contact with a downstream end part of the elastic restricting member 60.

When the sheet S1 is further conveyed from the state of FIG. 8A, the trailing end of the sheet S1 leaves the leading end portion 61 and comes into contact with the leading end areas 511A of the guide surface 511 as shown in FIG. 8B. This is because the leading end portion 61 of the elastic restricting member 60 is retracted the distance d toward the upstream side in the sheet conveying direction from the ridge 512 of the guide surface 511. Although the elastic restricting member 60 and the adhesive layer 70 are drawn in such a manner as to emphasize their thicknesses, these thicknesses are actually small. Thus, a step formed between the upper surface of the leading end portion 61 and the surfaces of the leading end areas 511A is very small. Therefore, the swing of the trailing end of the sheet S1 is small when the trailing end of the sheet S comes into surface contact with the leading end areas 511A after leaving the leading end portion 61.

Thereafter, when the sheet S1 is further conveyed, the trailing end of the sheet S1 leaves the ridge 512 of the guide surface 511 and comes into contact with the tip slant 53 as shown in FIG. 8C. The trailing end of the sheet S1 is gradually separated from the circumferential surface 11A of the photoconductive roller 11 by being guided by this tip slant 53. Accordingly, the trailing end of the sheet S1 does not suddenly swing in the direction away from the circumferential surface 11A immediately after leaving the guide surface 511. In this way, the swinging movement of the trailing end of the sheet S1 is moderated by temporarily coming into contact with the leading end areas 511A and, thereafter, the trailing end is moderately guided downward by the tip slant 53 after the trailing end of the sheet S1 leaves the leading end portion 61 of the elastic restricting member 60. Therefore, it is possible to suppress the flapping of the trailing end of the sheet S1 and prevent the occurrence of blurring in the transferred image.

If the tip slant 53 is not present and the downstream end of the rigid restricting member 50 is a vertical end surface at the position of the ridge 512, the trailing end of the sheet S1 is no longer restricted and largely swings in the direction away from the circumferential surface 11A. According to this embodiment, such a problem can be avoided by forming the tip slant 53.

Figure 9A:
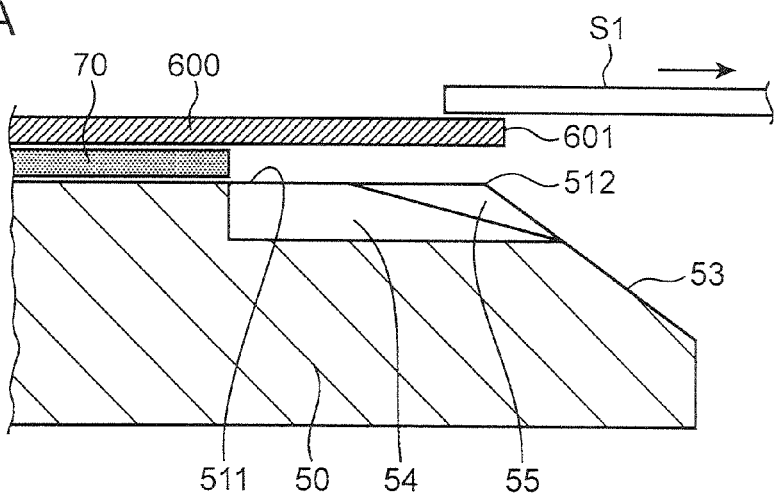
FIGS. 9A and 9B are side views in section showing a state where the trailing end of a sheet is passing through a guide member according to a comparative example.
Figure 9B:
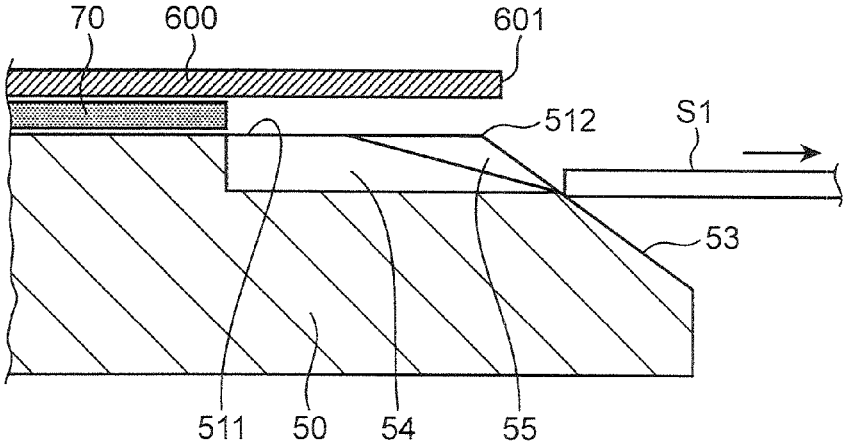

FIGS. 9A and 9B are side views in section showing a state where the trailing end of a sheet S1 passes above an elastic restricting member 600 according to a comparative example. Here is shown an example in which the elastic restricting member 600 is adhered onto the rigid restricting member 50 in a state where a leading end portion 601 thereof reaches the ridge 512 of the guide surface 511. FIG. 9A shows a state immediately before the trailing end of the sheet S1 leaves the leading end portion 601 and FIG. 9B shows a state immediately after the trailing end of the sheet S1 leaves the leading end portion 601. In this case, the trailing end of the sheet S1 cannot temporarily come into contact with the guide surface 511. Thus, although the tip slant 53 is provided on the rigid restricting member 50, the trailing end of the sheet S1 drops a long distance. Therefore, the flapping of the trailing end of the sheet S1 cannot be sufficiently suppressed.

Although not shown, for the sheet S2 having a postcard size, the swing of the trailing end is suppressed by the same behavior as described above. In the case of the sheet S2, the leading end portion 61 is kept curved downward as shown in FIG. 7B immediately until the trailing end thereof leaves the leading end portion 61 of the elastic restricting member 60. Thus, a step between the leading end portion 61 and the bottom surface 541 of the cut portion 54 is small.

Thereafter, the trailing end of the sheet S2 comes into contact with a downstream side of the bottom surface 541 of the cut portion 54. This is because the downstream end edge 541T of the bottom surface 541 is located more downstream in the sheet conveying direction than the leading end portion 61. Thereafter, the trailing end of the sheet S2 leaves the downstream end edges 541T and is guided by the tip slant 53. This is because the downstream end edge 541T of the bottom surface 541 is formed in the tip slant 53. Thus, the sheet S2 temporarily comes into contact with the bottom surface 541 to moderate the swinging movement after leaving the downwardly curved leading end portion 61 of the elastic restricting member 60 and, thereafter, is moderately guided downward by the tip slant 53. Therefore, it is possible to suppress the flapping of the trailing end of the sheet S2 and prevent the occurrence of blurring in the transferred image.

Figure 10:
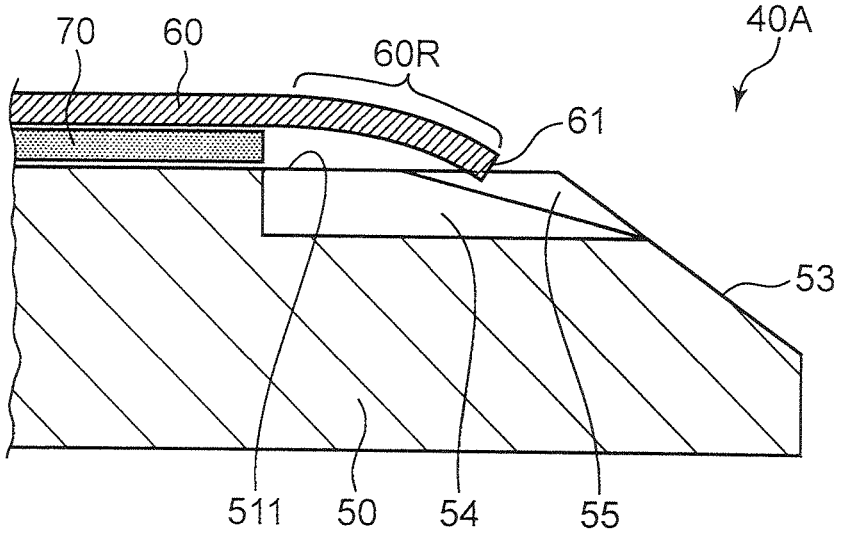
FIG. 10 is a side view in section showing another embodiment of the guide member.

FIG. 10 is a sectional view showing an essential part of a guide member 40A according to a modification. Although the basic configuration is the same as the guide member 40 described above, this guide member 40A differs in including a curved portion 60R curled in a direction toward the guide surface 511 (downward direction). The curved portion 60R is formed by curling a part corresponding to the non-adhesion area 62 described above with reference to FIG. 6.

A technique of curling described above is not particularly limited. A base material sheet of the elastic restricting member 60 may be wound around a suitable cylindrical body and a curved state may be fixed, such as by applying a heating treatment. Further, if the base material sheet is wound around a roll core and originally curly, that curly state may be utilized. Since the curved portion 60R reliably comes into contact with the guide surface 511 according to this modification, electrical contact between the elastic restricting member 60 and the rigid restricting member 50 can be ensured without depending on the pressing force of the sheet S.

Figure 11B:
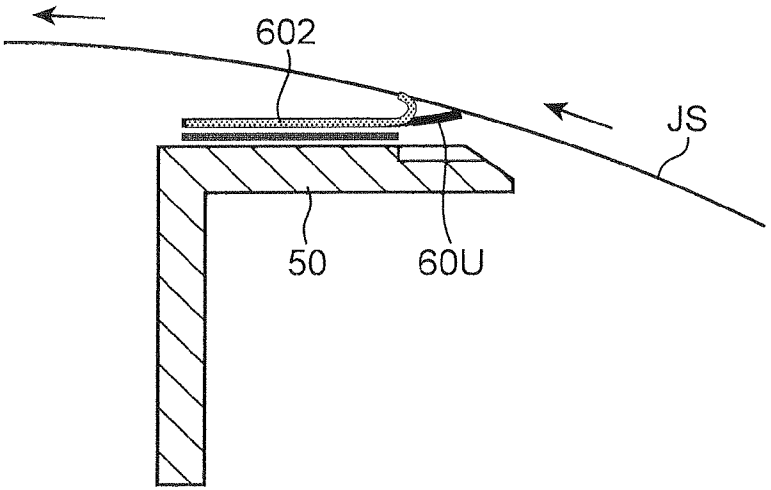
FIGS. 11A and 11B are diagrams showing the operation of the guide member of FIG. 10.
Figure 11A:
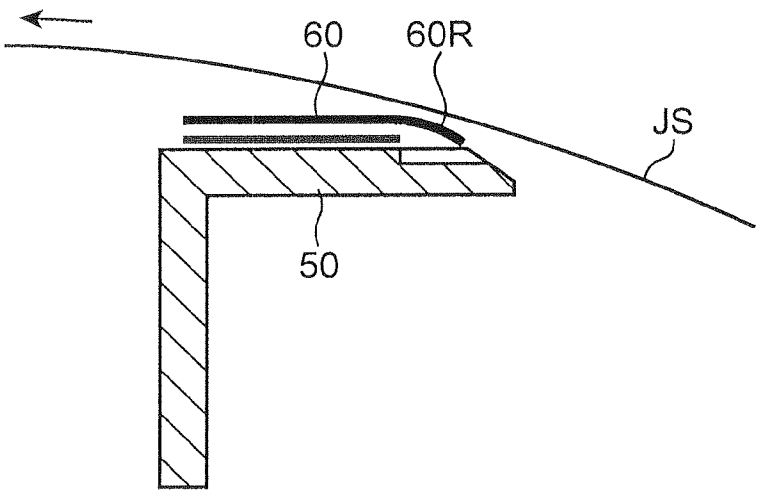

Further, there is also an advantage that the guide member 40A (elastic restricting member 60) is not damaged due to the pulling of a sheet when a sheet jam occurs in the sheet conveyance path 30. With reference to FIGS. 11A and 11B, a jammed sheet JS may be pulled in a direction opposite to the original sheet conveying direction when a sheet jam occurs.

If the elastic restricting member 60 includes the curved portion 60R curled downward as show in FIG. 11A, the curved portion 60R is not turned up even if the jammed sheet JS is pulled in the direction opposite to the sheet conveying direction. A downward pressing force solely acts on the curved portion 60R while the curved portion 60R is rubbed by the under surface of the jammed sheet JS. However, if a downstream end part of the elastic restricting member 60 is a curved portion 60U curled upward as shown in FIG. 11B, the curved portion 60U is easily turned up by the pulling of the jammed sheet JS. Thus, it is preferable to provide the downwardly curled curved portion 60R on the downstream end part of the elastic restricting member 60 as shown in FIG. 10.

According to the image forming apparatus 1 according to this embodiment described above, the occurrence of image defects such as image blurring and missing images due to the guide member 40 arranged immediately upstream of the transfer nip portion N can be prevented and contribution can be made to high-quality image formation.

Although the embodiments of the present disclosure have been described above, the present disclosure is not limited to these and can be, for example, embodied as follows.

(1) In the above embodiment, the example is shown in which the tip slant 53 in the form of a flat surface is formed on the downstream end of the rigid restricting member 50. Instead of this, the tip slant 53 may have a moderate convex or concave surface. Alternatively, the formation of the tip slant 53 may be omitted.

(2) In the above embodiment, the example is shown in which the non-adhesion area 62 is formed on the downstream side of the elastic restricting member 60. If electrical conduction between the rigid restricting member 50 and the elastic restricting member 60 is ensured by another means, the entire area (excluding a part corresponding to the cut portion 54) of the elastic restricting member 60 may be adhered to the guide surface 511 without providing the non-adhesion area 62.

(3) In the above embodiment, the example is shown in which the entire area of the elastic restricting member 60 except the non-adhesion area 62 on the downstream side is adhered to the guide surface 511 by the adhesive layer 70. Instead of this, another non-adhered portion may be provided in an area other than the non-adhesion area 62.

Figure 12:
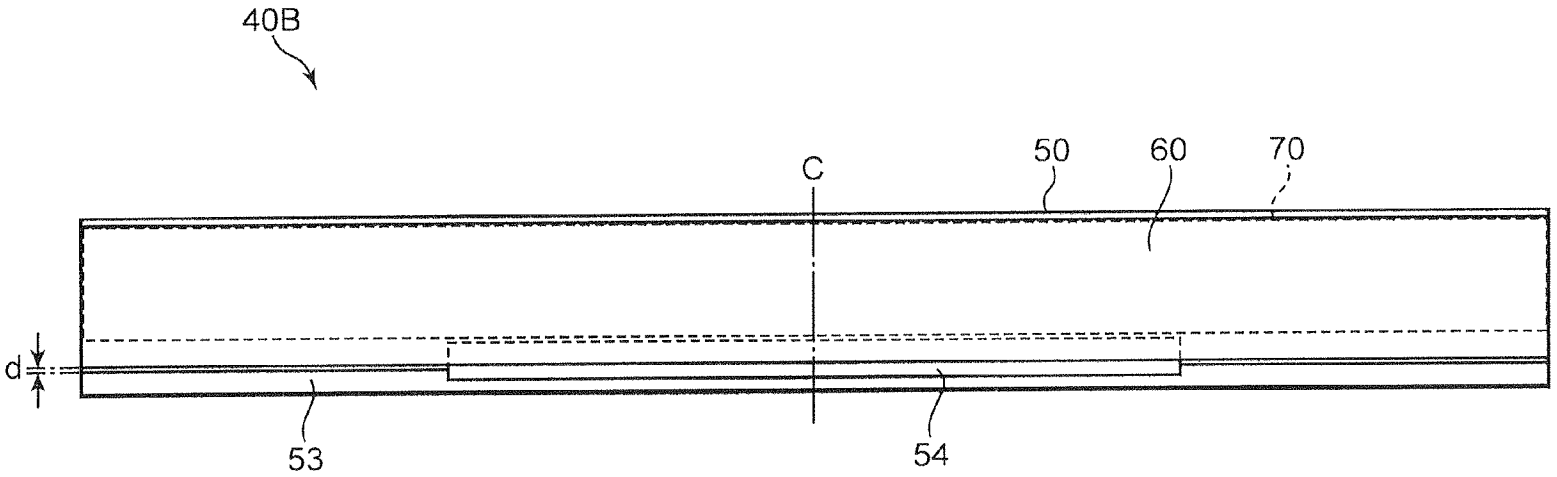
FIG. 12 is a top view showing another embodiment of the guide member.

(4) FIG. 12 is a top view showing a guide member 40B according to a modification. In the above embodiment, the example is shown in which the moderating surfaces 55 are provided on the opposite ends of the cut portion 54 of the rigid restricting member 50. If a degree of rubbing a sheet S against the tops of the side walls 543 of the cut portion 54 is small, the formation of the moderating surfaces 55 may be omitted as shown in FIG. 12. Alternatively, instead of providing cut surfaces such as the moderating surfaces 55, the tops of the side walls 543 and their peripheries may be coated with a coating material having a low coefficient of friction.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image bearing member including an image bearing surface for bearing a toner mage to be transferred to a sheet;

a transfer member arranged such that a circumferential surface thereof is in contact with the image bearing surface, a transfer nip portion being formed between the transfer member and the image bearing member; and a guide member arranged near an upstream side of the transfer nip portion in a sheet conveying direction and guiding an under surface side of the sheet being conveyed in a horizontal direction to introduce the sheet to the transfer nip portion;

wherein the guide member includes:

a rigid restricting member formed of a rigid member and including a guide surface which faces the under surface side of the sheet being conveyed;

a cut portion formed by recessing a leading edge part of the guide surface on a downstream side in the sheet conveying direction and in proximity to the leading end part and having a predetermined width along a sheet width direction perpendicular to the sheet conveying direction; and a sheet-like elastic restricting member formed of an elastic member and arranged on the guide surface to cover the cut portion; and wherein:

the elastic restricting member includes an end edge portion extending straight in the sheet width direction on a downstream side of the elastic restricting member in the sheet conveying direction;

a ridge defining the leading edge part of the guide surface is a ridge extending straight in the sheet width direction;

the end edge portion of the elastic restricting member is arranged at a position shifted toward an upstream side in the sheet conveying direction from the ridge of the guide surface;

a length of the cut portion in the sheet width direction is shorter than a length of the guide surface in the sheet width direction and a center of the cut portion in the sheet width direction coincides with a center of the guide surface in the sheet width direction;

the rigid restricting member includes a tip slant connected to the guide surface on a side downstream of the ridge of the guide surface in the sheet conveying direction and is so arranged with respect to the image bearing member that an extended line of the guide surface intersects with the image bearing surface and the tip slant faces the image bearing surface in an end view viewed in the sheet width direction; and a downstream end edge of a bottom surface of the cut portion in the sheet conveying direction is located in the tip slant.

2. An image forming apparatus according to claim 1, wherein:

the guide member includes moderating surfaces respectively extending from end parts of the cut portion in the sheet width direction to end parts of the guide surface in the sheet width direction and configured to moderate a step between the ridge of the guide surface and the bottom surface of the cut portion.

3. An image forming apparatus according to claim 1, wherein:

the guide member further includes an adhesive layer for adhering the guide surface and the under surface of the elastic restricting member;

the rigid restricting member and the elastic restricting member are formed of electrically conductive members;

a downstream end area of the elastic restricting member in the sheet conveying direction serves as a non-adhesion area; and the adhesive layer adheres the guide surface and the under surface of the elastic restricting member at least except in the non-adhesion area.

4. An image forming apparatus according to claim 3, wherein:

the cut portion includes a bottom surface which is flat and long in the sheet width direction and a rear wall which stands up from an upstream end of the bottom surface in the sheet conveying direction;

a downstream end of the adhesive layer in the sheet conveying direction is an end edge which extends straight in the sheet width direction and is located near the rear wall of the cut portion; and parts of the guide surface located on opposite sides of the cut portion and the elastic restricting member come into contact.

5. An image forming apparatus according to claim 3, wherein:

the non-adhesion area of the elastic restricting member is curled in a direction toward the guide surface.

* * * * *